United States Patent [19]

Steele, Jr.

[11] Patent Number: 5,061,082

[45] Date of Patent: Oct. 29, 1991

[54] REPLACEABLE PUG MILL BLADE

[75] Inventor: Alexis P. Steele, Jr., Pawley's Island, S.C.

[73] Assignee: J.C. Steele & Sons, Inc., Statesville, N.C.

[21] Appl. No.: 441,940

[22] Filed: Nov. 27, 1989

[51] Int. Cl.[5] ..... B01F 7/04

[52] U.S. Cl. ..... 366/325; 366/66; 366/331; 366/343

[58] Field of Search ..... 366/64, 66, 1, 2, 77, 366/42, 96, 97, 98, 99, 241, 243, 244, 245, 247, 257, 258, 285, 286, 325, 326, 331, 342, 343, 606, 291, 300; 416/223 R, 224, 225, 231 A, 235

[56] References Cited

U.S. PATENT DOCUMENTS

| | | | |
|---|---|---|---|
| 354,104 | 12/1886 | Deam . | |
| 967,646 | 8/1910 | Laun . | |
| 1,555,964 | 10/1925 | Guedel | 366/66 |
| 2,109,077 | 2/1938 | Straight | 366/309 X |
| 2,187,897 | 1/1940 | Bollard . | |
| 2,570,042 | 10/1951 | West . | |
| 2,802,650 | 8/1957 | Straight | 366/343 |
| 3,020,025 | 2/1962 | O'Mara . | |
| 3,195,869 | 7/1965 | Paine | 366/342 |
| 3,591,146 | 7/1971 | Sutter . | |
| 3,773,436 | 11/1973 | Lutz | 416/224 X |
| 4,304,494 | 12/1981 | Lutz | 366/325 X |
| 4,775,239 | 10/1988 | Martinek . | |
| 4,810,099 | 3/1989 | Langsetmo et al. . | |
| 4,877,327 | 10/1989 | Whiteman, jr. | 366/331 X |

FOREIGN PATENT DOCUMENTS

| | | | |
|---|---|---|---|
| 264374 | 1/1927 | United Kingdom | 366/64 |

*Primary Examiner*—Harvey C. Hornsby
*Assistant Examiner*—C. Cooley
*Attorney, Agent, or Firm*—Bell, Seltzer, Park & Gibson

[57] ABSTRACT

The invention is directed to an improved mixing arrangement for securing the blade to the shank of a mixing apparatus. The blade includes a borehole which overlies and surrounds a substantial portion of the shank so as to substantially reduce direct abrasive contact of the shank. Accordingly, the shank has longer life. Further the blade is mounted and secured by a single bolt which when unsecured allows the blade to be axially moved off the shank from an upright position which is most easily accessible by a person performing maintenance on the mixing apparatus.

17 Claims, 2 Drawing Sheets

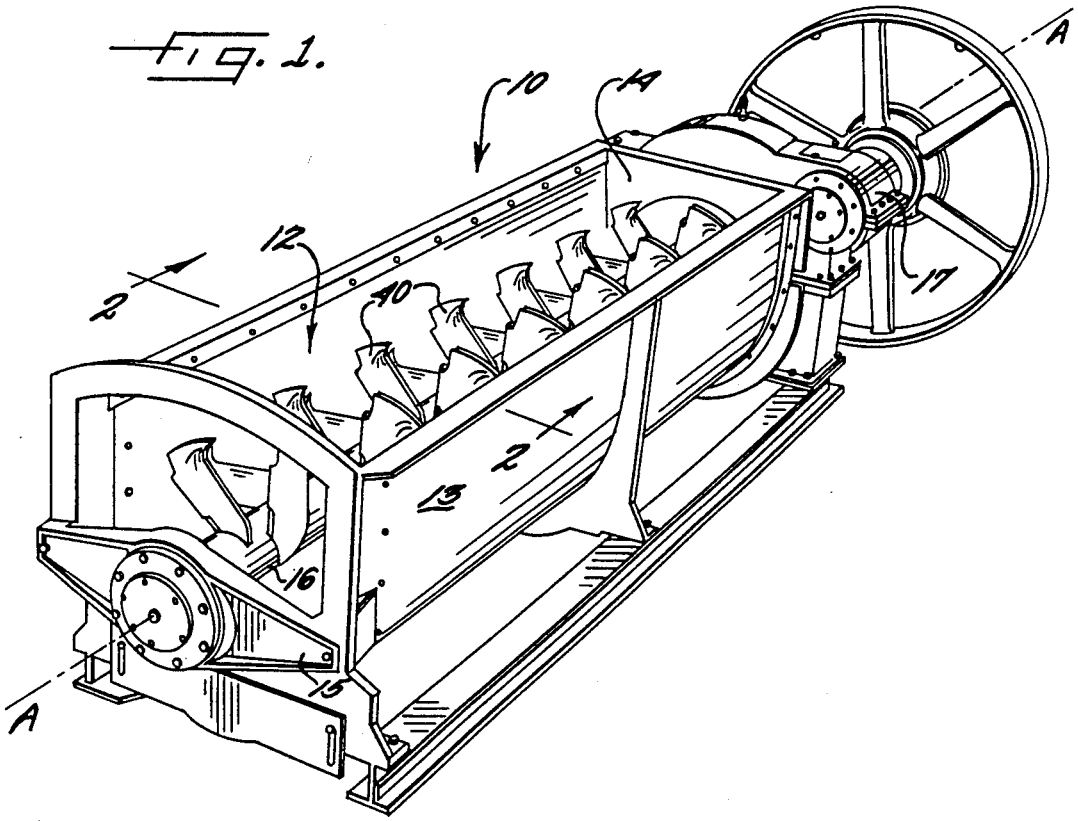
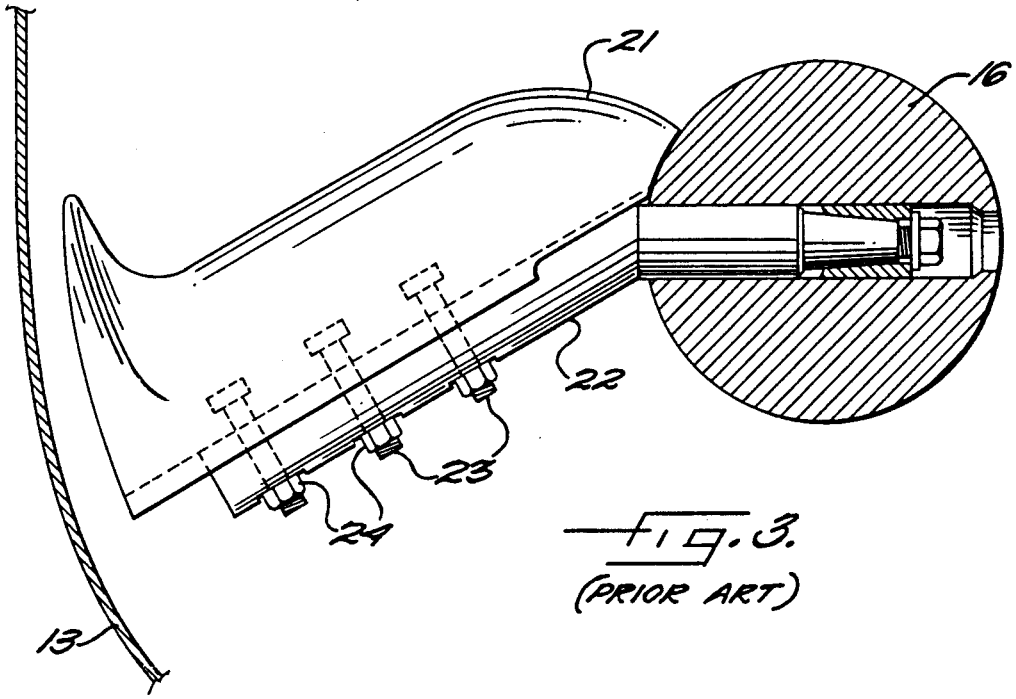
Fig. 3.
(PRIOR ART)

REPLACEABLE PUG MILL BLADE

FIELD OF THE INVENTION

This invention relates to apparatuses for mixing materials, particularly abrasive aggregate materials such as clay, sand and concrete which are used in the construction and brick and block making industry. The invention more particularly relates to the mounting of rotating blades in such mixing apparatuses.

BACKGROUND OF THE INVENTION

It is conventional to mix and mill aggregate materials in the preparation of forming a casting such as concrete or for the forming of bricks, blocks and other cast items. Machines for performing such mixing and milling, sometimes referred to as pug mills, are illustrated in U.S. Pat. No. 2,187,897 to Bollard issued Jan. 23, 1940, U.S. Pat. No. 2,570,042 to West issued Oct. 2, 1951 and U.S. Pat. No. 4,775,239 to Martinek et al. issued Oct. 4, 1988.

Bollard, West and Martinek are directed primarily to replaceable blades bolted at the ends of mounting shanks. The blades are subjected to substantial abrasion and wear and it is thus necessary for the blades to be replaceable. However, the shanks to which the blades are mounted and even the bolts which secure the blades to the shanks are also subjected to substantial abrasion and wear. Accordingly, in conventional pug mills it is frequently necessary to replace the mounting shanks as well which presents a substantial disadvantage and cost. The above patented designs provide for relatively easily replaceable blades, however, replacement of the shanks may cause substantial down time for the mixing apparatus as well as additional costs for replacement items.

A different prior art arrangement for securing the blade to the shaft is illustrated in FIG. 3 in the attached drawing. The prior art blade 21 is formed of a heavy cast material which is carried on the rotating shaft by a shank 22. The shank 22 is secured to the shaft and extends generally radially from the shaft. The blade 21 is cast with a series of threaded bolt portions 23 extending from the rearward portion of the blade so as to be inserted through corresponding holes in the shank 22. Nuts 24 secure the bolt portions and thereby hold the blade 21 firmly to the shank 22. However, this prior art arrangement has several disadvantages. As with the references discussed above, the shank 22 is exposed to the abrasive effects of the aggregate material which tends to wear out the shank 22 and the nuts 24. Further, replacement of the blade 21 is a difficult and laborious task because of the problem of aligning the bolts with the holes in the shank which is made further difficult by substantial weight of the blade 21 and the confined working area.

Accordingly it is an object of the present invention to provide an apparatus for mixing aggregate materials which avoids the drawbacks of the prior art as noted above and provides longer lasting life for the shank.

It is a more particular object of the present invention to provide an apparatus for mixing aggregate materials with a longer lasting life for the shank and for the bolt securing the blade to the shank.

It is a further object of the present invention to provide an apparatus for mixing aggregate materials with an improved blade design which facilitates easier replacement of the blade.

SUMMARY OF THE INVENTION

The above and other objects of the invention are achieved by the provision of a mixing apparatus comprising an elongate trough having a material inlet and a material outlet at generally opposite ends thereof. An elongate shaft (or shafts) is mounted lengthwise in the trough for rotary movement about a predetermined axis and a motor and gear box are connected to the shaft for rotating the shaft about the predetermined axis. At least one shank is mounted to the shaft along the length thereof and extending generally radially outwardly therefrom so as to rotate about the predetermined axis with the shaft. Preferably, a plurality of shanks are spaced along the length of the shaft and extend therefrom at various angles. An elongate blade is mounted to each shank for rotary movement about the axis to mix the material wherein the blade overlies a substantial portion of the shank and substantially reduces abrasive contact of the shank with the aggregate material being mixed.

BRIEF DESCRIPTION OF THE DRAWINGS

Some of the objects of the invention have been stated and other objects will appear as the description proceeds when taken in conjunction with the accompanying drawings in which FIG. 1 is a top perspective view of a mixing apparatus embodying the features of the present invention;

FIG. 3 is an enlarged fragmentary sectional similar to FIG. 2 illustrating a prior art arrangement for attaching and securing the blade to the shank;

DETAILED DESCRIPTION OF THE PREFERRED EMBODIMENTS

Figure 2:
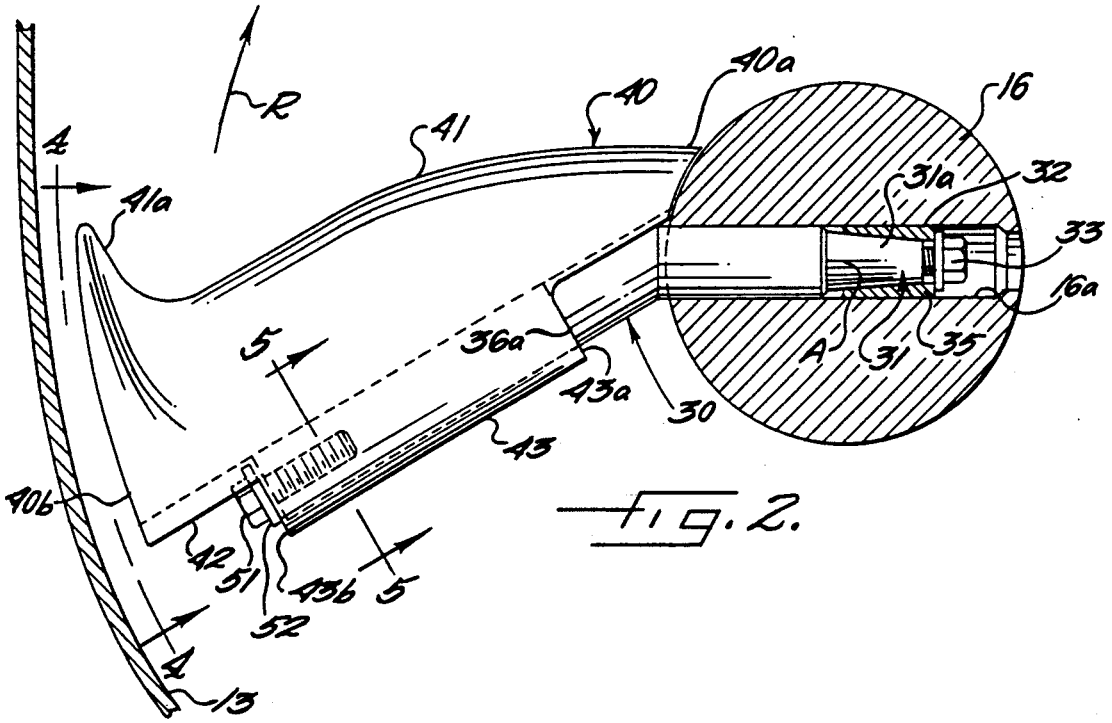
FIG. 2 is an enlarged fragmentary cross sectional view taken along line 2—2 in FIG. 1 illustrating a preferred embodiment of the present invention.

Referring now more particularly to the drawings, there is shown in FIG. 1 a mixing apparatus generally indicated by the numeral 10 for mixing concrete, clay and other aggregate materials to form a homogeneous mixture. The mixing apparatus 10 of the type illustrated is sometimes referred to as a pug mill by those knowledgeable in the art. Briefly, the mixing apparatus 10 comprises a trough 12 for receiving and carrying the material to be mixed. The mixing is accomplished by a rotating shaft 16 carrying a series of blades 40. The blades 40 are mounted to the shaft 16 by shanks 30 as will be described in greater detail below.

The mixing apparatus 10, illustrated in FIG. 1, more particularly comprises a trough 12 having an elongate "U" shaped wall 13. The "U" shaped wall 13 has a generally round lower portion with a circular cross section formed around a generally horizontal axis A. The upper portion of the trough 12 is typically open, as illustrated, although it may be closed by a suitable cover if desired. The trough 12 further includes generally closed ends 14 and 15 to retain the aggregate material in the trough 12.

An elongate shaft 16 is pOsitioned longitudinally with respect to the trough 12 so as to be COaxial with the axis A. The shaft 16 is supported by suitable bearings at the ends 14 and 15 so as to be rotatable about the axis A. Drive means such as a motor and gear box 17 is connected to the shaft 16 by a suitable transmission to rotate the shaft 16 which carries a plurality of blades 40 to mix the material. The material is received into the trough 12 at one end 14 by a suitable inlet as is known in the art and discharged by an outlet at the opposite end 15. The blades 40 have a predetermined angular pitch so as to move the material along the elongate trough 12 as the blades 40 rotate and mix the aggregate material. Accordingly, the aggregate material is moved along at a relatively slow predetermined speed to the outlet so as to mix the material in a continuous process. The mixed material may then be provided to various other devices as known by those having skill in the art to form bricks or blocks or other useful articles.

Figure 4:
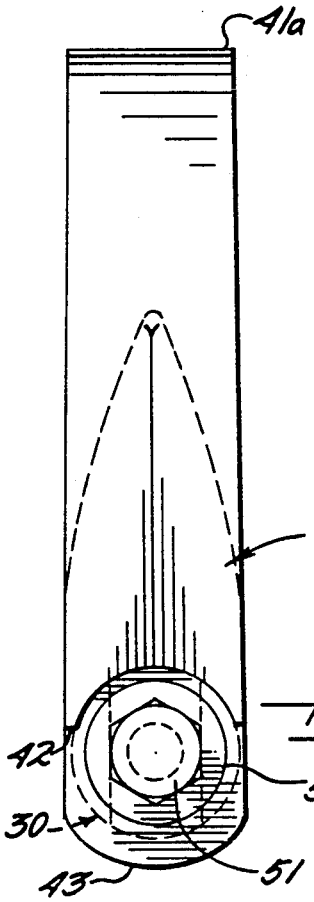
FIG. 4 is a enlarged sectional view taken along line 4—4 in FIG. 2.
Figure 5:
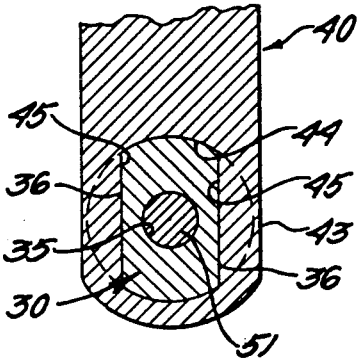
FIG. 5 is an enlarged sectional view taken along line 5—5 in FIG. 2.

Referring now to FIGS. 2, 4 and 5, the arrangement for mounting the blade 40 to the shaft 16 is more clearly illustrated. The blade 40 is mounted for rotation about the shaft 16 by a shank 30. The shank 30 is formed of a generally circular elongate bar arranged to extend generally radially from the shaft 16. In the preferred embodiment, the shank 30 is formed of hardened steel for strength and rigidity. As illustrated, the shank has about a 30° bend at about its midpoint so as to provide the blade 40 at an optimal angle with respect to the material being mixed. One end 31 of the shank 30 is adapted to be mounted to the shaft 16 in a mounting hole 16*a* so that the remainder of the shanks 30 extends generally radially outwardly from the shaft 16. The bend in the shank 30 is more precisely arranged adjacent the mounting hole 16*a* of the shaft 16 so that the remainder extending from the shaft 16 is generally straight and linear.

The one end 31 of the shank 30 for being mounted to the hole 16*a* has a tapered surface 31*a* for engaging an internally tapered collar 32. A bolt 33, threadedly received coaxially into the one end 31, moves the collar 32 along the tapered surface 31*a* of the shank 30 when tightened until the collar 32 expands out and grippingly engages the inner surface of the mounting hole 16*a* of the shaft 16.

Figure 6:
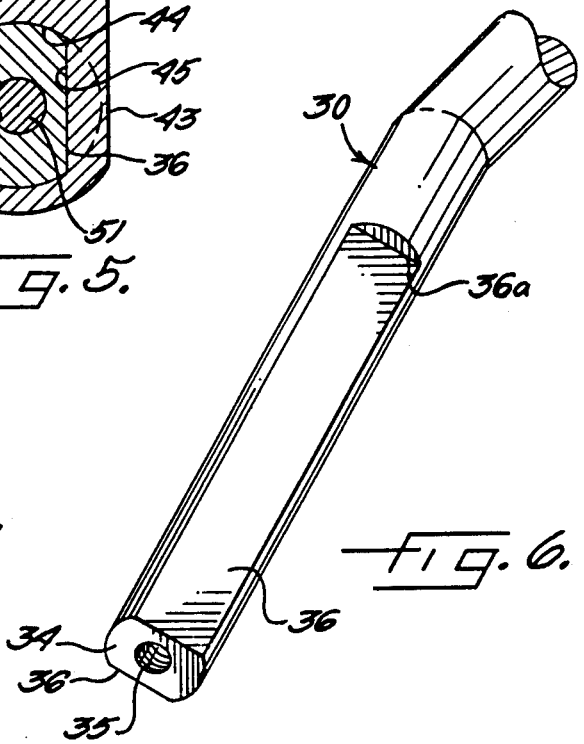
FIG. 6 is a fragmentary perspective view of a shank of the present invention illustrating specific features thereof.

The shank 30 has an opposite distal end 34 spaced from the shaft 16 which includes a threaded hole 35 (FIG. 6). The threaded hole 35 is generally aligned coaxial with the shank 30 and receives a bolt 51 to secure the blade 40 to the shank 30 as will be described below. The shank 30 further includes an opposed pair of flat portions 36 extending along opposite elongate sides of the shank 30 for a substantial portion of the length the shank 30. As can be seen more clearly in FIG. 6, in the preferred embodiment the flat portions 36 extend from the distal end 34 of the shank 30 about three quarters of the length to the bend of the shank 30. At the terminal end of the flat portions 36, opposite to the distal end 34 of the shank 30, the flat portions 36 form a shoulder 36*a* which provides a stop for the blade 40 as will be explained below.

The blade 40, as discussed above, is secured to the shank 30 to rotate about the shaft 16 to mix the aggregate material in the trough 12. The blade 40 must withstand substantial abrasion from the aggregate material and must be replaced at regular intervals. One of the features of the present invention is that the blade 40 is designed to incur substantially all the contact with the aggregate material being mixed and the abrasion therefrom so as to substantially reduce or eliminate the abrasion on the shank 30. Accordingly, the blade 40 is formed as an elongate body of a cast metal such as cast iron to overlie a substantial portion of the shank 30. The elongate body of the blade 40 has opposite ends 40*a* and 40*b* and a narrow leading edge 41 extending along substantially the length of the blade 40. The leading edge 41 of the blade 40 is generally disposed in the direction of rotation of the blade as indicated by arrow R. A generally blunt trailing edge 42 is opposite the leading edge 41 and in the preferred embodiment has an elongate channel therein. At the distal end 40*b*, the blade 40 includes a spade-like forward extension 41*a* for lifting material from the "U" shaped wall 13 to provide thorough mixing of the material and prevent material from settling at the bottom portion of the trough 12. Extending rearwardly along the trailing portion 42 of the blade 40 is an elongate flange 43 which is spaced inwardly at its opposite ends 43*a*, 43*b* so as to not extend the full length of the body of the blade 40. The flange 43 includes a bore hole 44 extending lengthwise through the flange 43 which overlies the shank 30. The bore hole 44 has a shape complementary to the shape of the shank 30 so as to facilitate a secure attachment of the blade 40 to the shank 30.

In particular, it is desired that the blade 40 be prevented from rotating with respect to the shank 30 so as to maintain a predetermined orientation of the leading edge 41 of the blade 40 with respect to the direction of rotation R. Accordingly, the bore hole 44 has flat sides 45 opposite one another to align and overlie with the flat portions 36 on the shank 30 as best seen in FIG. 5. The remaining portions of the bore hole 44 are generally circular to conform to the circular configuration of the remaining portion of the shank 30 so as to slide along the length of the shank while preventing relative rotation between the blade 40 and shank 30. It should be recognized that the complimentary shapes of the shank 30 and the bore hole 44 may take other various shapes. In the preferred embodiment, the complimentary flat portions provide a simple and operable arrangement for engaging the shank 30 with the blade 40.

The bore hole 44 is further arranged to have substantially the same length as the flat portions 36 on the shank 30 such that the end 43*a* of the flange 43 engages the shoulder 36*a* to limit the depth the shank 30 may be inserted into the bore hole 44. The other end 43*b* of the flange 43 is therefore generally aligned with the distal end 34 of the shank 30. A bolt 51 is threadedly received into the hole 35 in the shank 30, as discussed above, to engage the opposite end 43*b* of the flange 43 to secure the end 43*a* against the shoulder 36*a* and thereby secure the blade 40 onto the shank 30. Stated in other terms, the flange 43 is compressed between the shoulder 36*a* and the bolt 51. A washer or similar device 52 may be positioned between the bolt 51 and the shank 30 to enlarge the area of contact on the end 43*b* of the flange 43 by the bolt 51 as best seen in FIG. 4.

An important benefit of the invention is the ease and simplicity of replacing a blade 40. To replace a blade 40, the shaft 16 is rotated until the blade 40 to be replaced is uppermost in the trough 12. The bolt 51 and washer 52 are removed from the distal end 34 and the blade 40 is lifted off the shank 30. A new replacement blade 40 is secured to the shank 30 by aligning the bore hole 44 with the shank 30 and lowering the blade down until the end 43*a* of the flange 43 abuts the shoulder 36*a*. With the bore hole 44 open through the flange, the repair person may view down the bore hole 44 to align the blade 40 over the shank 30. Once the blade 40 is placed over the shank 30, it will rest on the shoulder 36*a* while the bolt 51 and washer 52 are tightened into the threaded hole 35. Therefore, despite the weight of the blade 40, the repair person does not have to support the blade 40 while attempting to thread the bolt 51. Furthermore, the mounting arrangement provides that the blade 40 may be secured to the shank 30 by a single bolt 51.

Accordingly, it should be seen that the blade 40 overlies and encircles a substantial portion of the shank 30 so that as the blade 40 rotates about the shaft 16, the blade 40 substantially reduces the contact between the aggregate material and the shank 30. Accordingly the shank 30 will essentially have a longer useable life, preferably as long as the useful life of the mixing apparatus 10. Further, by the flange 43 having its distal end 43*b* spaced inwardly from the distal end of the blade, the bolt 51 is shielded from direct abrasive impingement with the aggregate material by the generally blunt trailing portion 42. In the preferred embodiment, the generally blunt trailing portion 42 has an elongate channel therein which further shrouds the bolt 51. The bolt 51 is positioned at least partially in the channel so as to more effectively shield the bolt 51 from direct abrasive impingement with the aggregate material while permitting access to the bolt 51 of the blade 40. As such, the bolt 51 will also have a longer useful life.

In the drawings and specification there has been set forth a preferred embodiment of the invention, and although specific terms are employed they are used in a generic and descriptive sense only and not for purposes of limitation.

That which is claimed is:

1. An apparatus for continuously mixing aggregate material comprising:

an elongate trough having a material inlet and a material outlet at generally opposite ends thereof;

an elongate shaft mounted lengthwise in said trough for rotary movement about a predetermined axis;

drive means connected to said shaft for rotating said shaft about said predetermined axis;

a plurality of shanks mounted to said shaft along the length thereof and extending generally radially outwardly therefrom so as to rotate about said axis with said shaft said shanks having a first end adapted for mounting to the shaft and a second distal end opposite from said first end, said distal end including a threaded axial hole;

an elongate blade mounted to each of said shanks for rotary movement with said shanks about said predetermined axis to mix the material wherein said blade overlies and shields a substantial portion of said shank to substantially reduce abrasive contact of the shank with the aggregate material, said blade comprising an elongate body with opposite ends, a leading edge generally disposed in the direction of rotation of the blade, a trailing portion opposite from the leading edge, and an elongate flange spaced inwardly from the distal end of said blade and extending rearwardly along the trailing portion wherein the elongate flange includes an elongate bore hole for receiving said shank therein to mount said blade to said shank, and bolt means for securing said blade to said shank wherein said trailing portion of said blade partially covers and shields said bolt means from direct abrasive impingement with the aggregate material, and wherein said bolt means includes a bolt received into said axial hole, at said distal end of said shank for securing said flange of said blade onto said shank, wherein said bolt is recessed from the distal end of said blade and said generally blunt trailing portion partially covers and shields the bolt head from direct abrasive impingement with the aggregate material.

2. The apparatus according to claim 1 wherein said shank is an elongate solid bar having a shoulder spaced from said distal end by a distance corresponding to said elongate bore hole in said flange of said blade so as to limit the depth the shank may be inserted into said elongate bore hold.

3. The apparatus according to claim 2 wherein said shank has a generally cross section and wherein said elongated blade encircles a substantial portion of said shank.

4. The apparatus according to claim 3 wherein said shank further includes flat portions along opposite elongate sides thereof extending from said distal end to said shoulder and wherein said bore hole in said flange of said blade includes complementary flat portions to overlie said flat portions of said shank so as to prevent relative rotation of said blade about said shank.

5. The apparatus according to claim 4 wherein the ends of said elongate flange are spaced inwardly from said opposite ends of said blade, and wherein said blade includes an elongate channel along said generally blunt trailing portion and said bolt is positioned at least partially in said channel so that said generally blunt trailing edge partially covers and shields said bolt from direct abrasive impingement with the aggregate material.

6. The apparatus according to claim 1 wherein said leading edge of said blade is narrow and extends substantially along the length of said blade and wherein said elongate trailing portion extending opposite from said leading edge is generally blunt.

7. An apparatus for continuously mixing aggregate material comprising:

an elongate trough having a material inlet and a material outlet at generally opposite ends thereof;

an elongate shaft mounted lengthwise in said trough for rotary movement about a predetermined axis;

drive means connected to said shaft for rotating said shaft about said predetermined axis;

a plurality of shanks mounted to said shaft along the length thereof and extending generally radially outwardly therefrom so as to rotate about said axis with said shaft and comprising an elongate generally circular bar having one end connected to said shaft, an opposite distal end spaced from said shaft, flat portions along opposite elongate sides thereof extending a substantial length of said shank from said distal end to a shoulder formed by the termination of said flat portions, and a threaded hole at said distal end of said shank formed generally coaxially with said shank;

an elongate blade mounted to each said shank for rotary movement about said predetermined axis to mix the material wherein said blade comprises an elongate body arranged to extend lengthwise with said shank and having opposite ends, a narrow leading edge extending substantially along the length of said blade and generally disposed in the direction of rotation of said blade, a generally blunt elongate trailing portion opposite from said leading edge, and an elongate flange extending rearwardly along said generally blunt trailing portion wherein said elongate flange includes an elongate bore hole extending therethrough for mounting said blade onto said shank such that the flange of said blade overlies a substantial portion of said shank and substantially reduces abrasive contact of said shank with the aggregate material; and a bolt received into said hole at said distal end of said shank for securing said flange of said blade onto said shank.

8. The apparatus according to claim 7 wherein said bore hole in said flange is approximately the same length as said flat portions on said shank so that said flange is secured to said shank between said bolt and said shoulder.

9. The apparatus according to claim 8 further including a washer between said bolt and said distal end of said shank to secure said flange of said blade to said shank.

10. The apparatus according to claim 7 wherein said flange has a length of at least half the length of the body of the blade.

11. The apparatus according to claim 7 wherein said blade is formed of cast iron and said shank is formed of steel.

12. An improved blade and shank combination adapted for use in a mixing apparatus of the type that includes a rotating shaft mounted lengthwise for rotation in an elongate trough for mixing aggregate material, said combination comprising:

an elongate shank having a first end adapted for mounting to the shaft of the mixing apparatus and a second distal end opposite from said first end, said distal end including a threaded axial hole, an elongate blade mounted to said shank for rotating about the shaft and mixing the aggregate material wherein said blade overlies and shields a substantial portion of said shank to substantially reduce abrasive contact of the shank with the aggregate material, said blade comprising an elongate body with opposite ends, a leading edge generally disposed in the direction of rotation of the blade, trailing portion opposite from the leading edge, and an elongate flange spaced inwardly from the distal end of said blade and extending rearwardly along the trailing portion wherein the elongate flange includes an elongate bore hole for receiving said shank therein to mount said blade to said shank, and bolt means for securing said blade to said shank wherein said trailing portion of said blade partially covers and shields said bolt means from direct abrasive impingement with the aggregate material, and wherein said bolt means includes a bolt received into said axial hole, at said distal end of said shank for securing said flange of said blade onto said shank, wherein said bolt is recessed from the distal end of said blade and said generally blunt trailing portion partially covers and shields the bolt head from direct abrasive impingement with the aggregate material.

13. The apparatus according to claim 12 wherein said shank is an elongate solid bar having a shoulder spaced from said distal end by a distance corresponding to said elongate bore hole in said flange of said blade so as to limit the depth the shank may be inserted into said elongate bore hole.

14. The apparatus according to claim 13 wherein said shank has a generally circular cross section and wherein said elongate blade encircles a substantial portion of said shank.

15. The apparatus according to claim 14 wherein said shank further includes flat portions along opposite elongate sides thereof extending from said distal end to said shoulder and wherein said bore hole in said flange of said blade includes complementary flat portions to overlie said flat portions of said shank so as to prevent relative rotation of said blade about said shank.

16. The apparatus according to claim 15 wherein the ends of said elongate flange are spaced inwardly from said opposite ends of said blade, and wherein said blade includes an elongate channel along said generally blunt trailing portion and said bolt is positioned at least partially in said channel so that said generally blunt trailing edge partially covers and shields said bolt from direct abrasive impingement with the aggregate material.

17. The combination according to claim 12 wherein said leading edge of said blade is narrow and extends substantially along the length of said blade, and wherein said elongate trailing portion extending opposite from said leading edge is generally blunt.

* * * * *

UNITED STATES PATENT AND TRADEMARK OFFICE

CERTIFICATE OF CORRECTION

PATENT NO. : 5,061,082

DATED : October 29, 1991

INVENTOR(S) : Alexis P. Steele, Jr.

It is certified that error appears in the above-identified patent and that said Letters Patent is hereby corrected as shown below:

Column 1, line 46, after the word "portions", please insert --23--.

Column 2, line 45, delete "EMBODIMENTS" and insert --EMBODIMENT--.

Column 3, line 1, delete "pOsition" and insert --position--.

Column 3, line 2, delete "COaxial" and insert --coaxial--.

Column 3, line 38, delete "31a" and insert --30a--.

UNITED STATES PATENT AND TRADEMARK OFFICE

CERTIFICATE OF CORRECTION

PATENT NO. : 5,061,082

DATED : October 29, 1991

INVENTOR(S) : Alexis P. Steele, Jr.

It is certified that error appears in the above-indentified patent and that said Letters Patent is hereby corrected as shown below:

Column 6, line 15, delete "hold" and insert --hole--.

Signed and Sealed this

Twenty-sixth Day of April, 1994

Bruce Lehman

*Attest:*

BRUCE LEHMAN

*Attesting Officer*

*Commissioner of Patents and Trademarks*